US008070081B2

(12) United States Patent
Wark

(10) Patent No.: US 8,070,081 B2
(45) Date of Patent: Dec. 6, 2011

(54) PRESSURE MONITOR FOR PULVERIZER

(76) Inventor: Rickey E. Wark, Spring, TX (US)

( * ) Notice: Subject to any disclaimer, the term of this patent is extended or adjusted under 35 U.S.C. 154(b) by 41 days.

(21) Appl. No.: 12/465,895

(22) Filed: May 14, 2009

(65) Prior Publication Data

US 2010/0288862 A1 Nov. 18, 2010

(51) Int. Cl.
*B02C 4/32* (2006.01)

(52) U.S. Cl. ..... 241/37

(58) Field of Classification Search ..... 241/119, 241/121, 37, 114, 117, 118, 120
See application file for complete search history.

(56) References Cited

U.S. PATENT DOCUMENTS

| | | | | |
|---|---|---|---|---|
| 3,580,022 | A * | 5/1971 | Waltz et al. | 72/10.3 |
| 3,702,554 | A * | 11/1972 | Shumaker | 72/13.4 |
| 3,771,359 | A * | 11/1973 | Shoberg | 73/862.044 |
| 4,382,561 | A * | 5/1983 | Andersen et al. | 241/121 |
| 4,485,974 | A * | 12/1984 | Lass | 241/30 |
| 4,575,972 | A * | 3/1986 | Ohki et al. | 451/424 |
| 4,597,487 | A | 7/1986 | Crosby et al. | |
| 4,809,190 | A | 2/1989 | Homer et al. | |
| 4,896,837 | A * | 1/1990 | Heinemann et al. | 241/12 |
| 5,076,026 | A * | 12/1991 | Mizuguchi et al. | 451/36 |
| 5,396,189 | A * | 3/1995 | Hays | 330/149 |
| 5,485,965 | A * | 1/1996 | Hostettler et al. | 241/29 |
| 5,957,300 | A * | 9/1999 | Nardi et al. | 209/143 |
| 6,182,914 | B1 * | 2/2001 | Carle | 241/30 |
| 7,182,283 | B1 * | 2/2007 | Santucci | 241/37 |
| 7,226,010 | B2 * | 6/2007 | Zhang et al. | 241/121 |
| 2006/0243839 | A9 * | 11/2006 | Barscevicius et al. | 241/261.2 |
| 2009/0008487 | A1 * | 1/2009 | Smith et al. | 241/114 |

FOREIGN PATENT DOCUMENTS

| | | | |
|---|---|---|---|
| CN | 2155945 | * | 2/1994 |
| ZA | 9006940 A | * | 6/1991 |

* cited by examiner

*Primary Examiner* — David J. Walczak
*Assistant Examiner* — Jennifer C Chiang
(74) *Attorney, Agent, or Firm* — Young Basile Hanlon & MacFarlane PC

(57) ABSTRACT

Load cells are placed in the pre-compression systems of spring suspended rollers in coal/ore crusher/classifiers to produce electrical signals representing actual forces generated in the suspension system during crusher operation. This permits forces to be closely monitored during operation and/or automatically adjusted. Alternatively or in addition, alarm signals can be generated when pressures go out of tolerance.

5 Claims, 8 Drawing Sheets

PRESSURE MONITOR FOR PULVERIZER

FIELD OF THE INVENTION

This invention relates to pulverizers for coal, ore and other materials and more particularly to an improvement which facilitates the precise control of forces in the crusher structure.

BACKGROUND OF THE INVENTION

Crusher/classifier devices are commonly used by electricity generating utilities and other companies to pulverize coal for use in tangential spray combustion chambers. Briefly described, a crusher/classifier comprises a rotatable dish or bowl-shaped table onto which lump coal is deposited by gravity feed, and a plurality of crusher wheels which rollingly contact the table to crush the coal into smaller particles. The classifier function is usually of the updraft type and uses air-flow to send the fully crushed fine particles toward the combustion chamber while returning incompletely crushed larger particles or chunks back to the crusher for further processing.

In all cases, the crusher rollers are equipped with and/or mounted to a carriage having a spring-type suspension system which can be adjusted to increase or decrease the crusher force. The adjustment feature determines the amount of pre-compression to be applied to the springs in the suspension system and this, in turn, determines the area along the force-displacements curve associated with the springs in which the system operates. In accordance with Hooke's Law, operating farther out along the force-displacement curve increases the force with which the crusher rollers contact the table. As persons knowledgeable with respect to crusher/classifiers will readily understand, the amount of pre-compression must be limited to allow adequate travel in the compression springs to prevent damage to the equipment in the event an uncrushable foreign object, such as a chunk of metal enters the system.

Crusher/pulverizer devices are available from several sources and utilize somewhat different designs, the largest areas of differences occurring in the size, type and location of the crusher roller suspension systems, the manners in which the suspension systems are anchored, and in the manner in which crusher force is adjusted. Two different crusher/classifiers are described in this document. The crusher force adjustment systems can be purely mechanical and manually adjusted or they can incorporate various types of actuators such as hydro-pneumatic devices which facilitate the adjustment process. Once such system incorporating adjusters of this type is disclosed herein.

Despite the fact that the particle size or "fineness" of coal delivered to the combustion chamber spray nozzles is critical to combustion, slag formation and other operational characteristics, I have found that crusher pressure is not carefully monitored or regulated on a day-to-day or hour-by-hour basis. Instead, crushers are adjusted and then turned on to run unmonitored for long periods of time. I have found that the pressure settings tend to vary with time and may result in different settings at the corners of the suspension system. I have also found that, unless an individuals is closely monitoring the crusher/classifier operation, the entry of an uncrushable foreign object such as a metal chunk into the system often goes unnoticed. This can result not only in poor pressure/classifier performance until the object is removed but may also result in damage to the equipment.

SUMMARY OF THE INVENTION

According to my invention, the crusher force setting for each roller in a multi-roller crusher/pulverizer system is closely electronically monitored to close tolerances throughout crusher/pulverizer operation. In general, this is accomplished by incorporating load cells into the suspension mechanisms to produce electrical signals representing the actual crusher force being experienced by each crusher roller at any given time. These electrical data signals can be fed not only to a display to facilitate the initial setting as well as to monitor conditions during operation, but may also be fed to a processor which detects out-of-balance conditions as well as crusher roller oscillations which indicate the presence of a foreign object on the crusher table.

In an even more sophisticated system using externally controllable actuators in the adjustment mechanisms, I incorporate a feedback loop which compares the actual pressure readings obtained from the load cell force transducers to desired or "reference" settings and produces an error signal which can be applied to an automatic adjuster mechanism to reduce the error signal to zero. This maintains the desired crusher pressure settings throughout an operating run and, when properly used, results in far superior crusher/classifier performance and improved combustion chamber performance.

My invention is not limited to use with coal crushers but may also be used in crusher/classifier devices processing other materials including precious metal ores.

BRIEF DESCRIPTION OF THE DRAWINGS

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
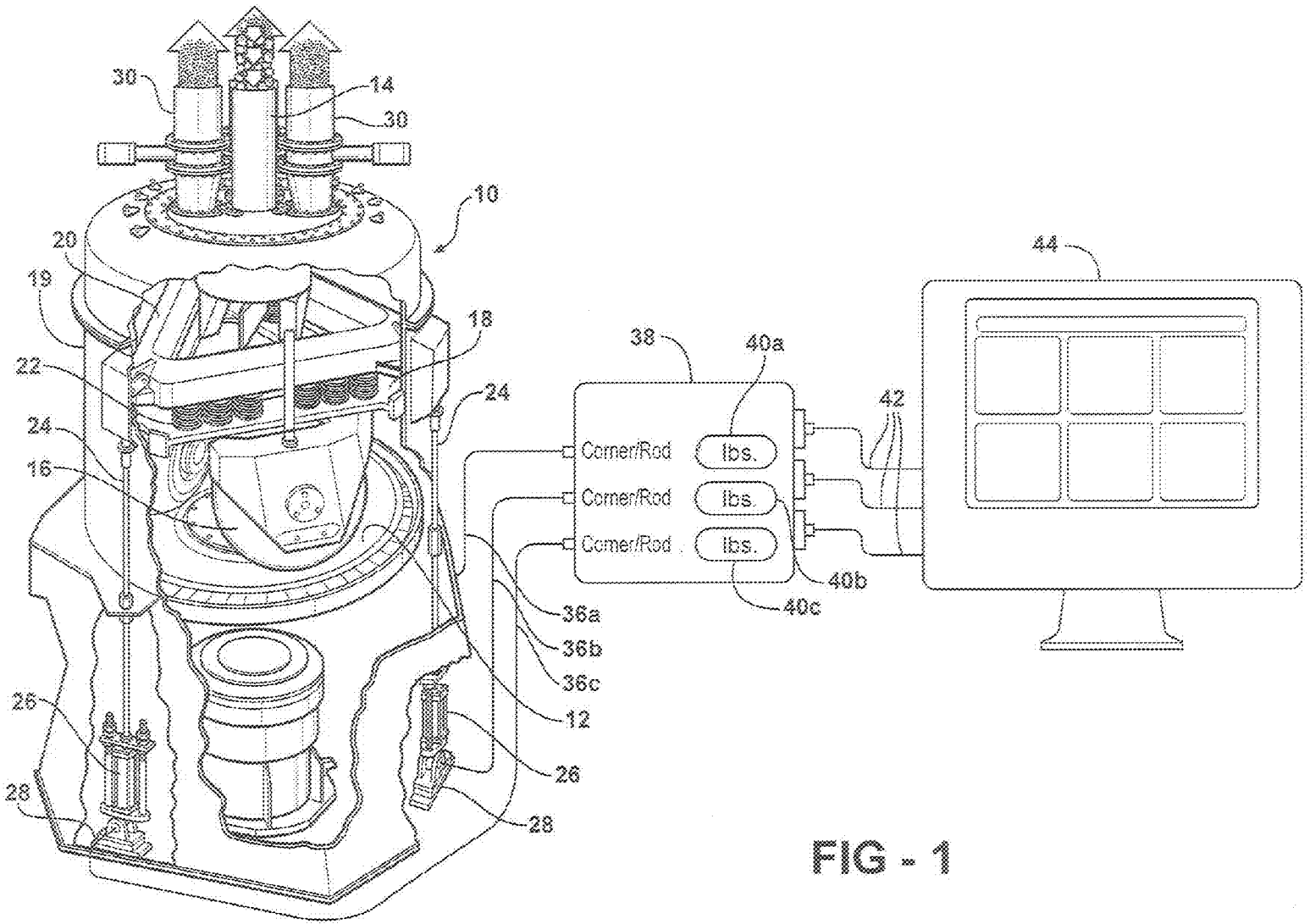
FIG. 1 is a diagram of a crusher classifier system incorporating my invention including a monitoring display and a processor.
Figure 2:
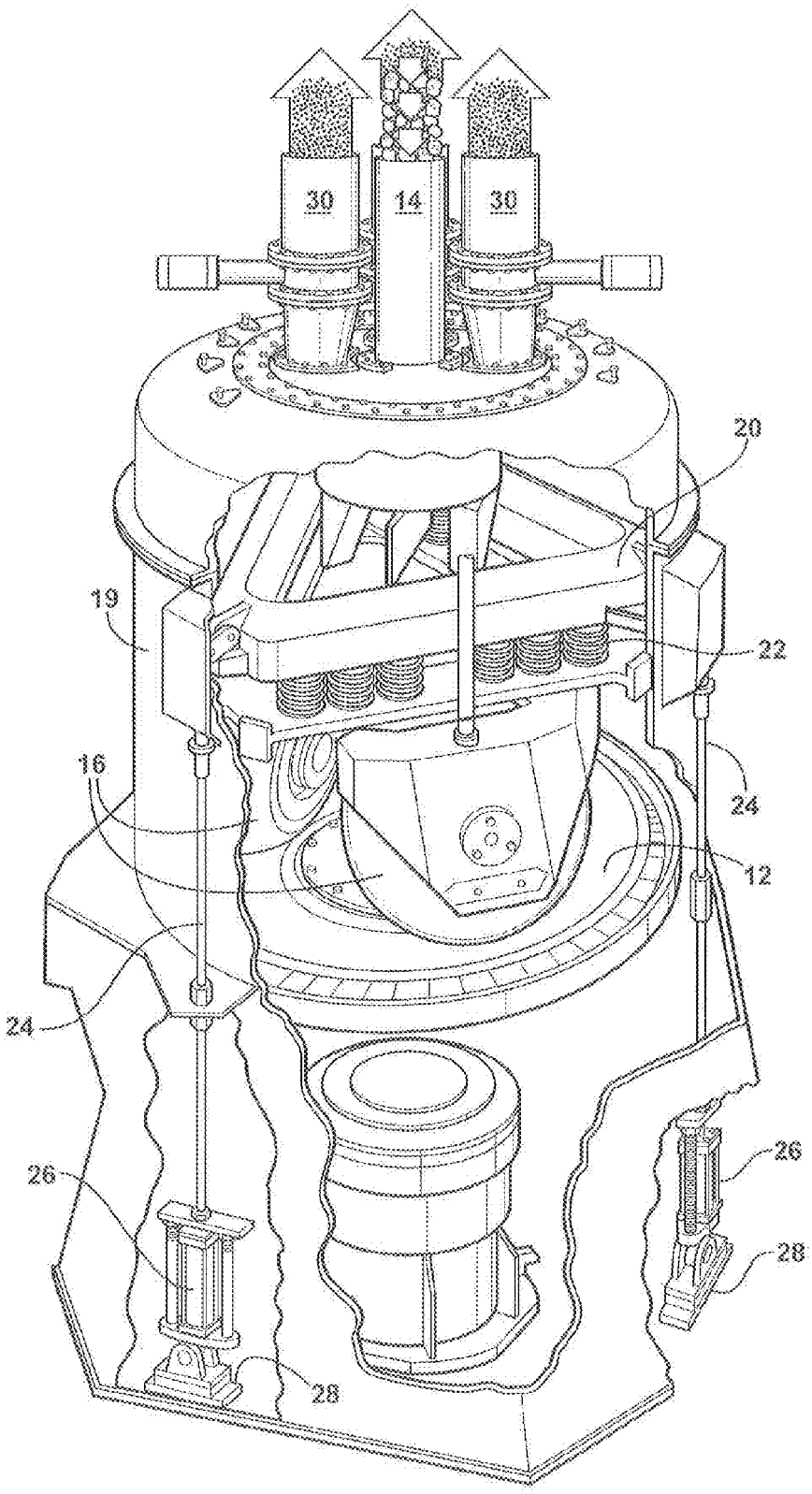
FIG. 2 is an enlarged, detailed drawing of a crusher/classifier utilizing my invention.

Referring now to FIGS. 1 through 5, there is shown a crusher/classifier 10 of the updraft type having a bowl-shaped, motor driven, rotatable table 12 onto which coal is deposited by a gravity feed inlet 14 so that it can be contacted by crusher rollers 16, the rollers 16 being three in number and being attached to a triangular carriage plate 18 in the crusher/classifier housing 19. The plate 18 and the crusher rollers 16 can be displaced vertically to accommodate material between the contact surfaces of the rollers 16 and the surface of the table 12. The plate 18 is connected through compression springs 22 through a triangular suspension mantle 20. The mantle 20 is, in turn, connected to a set of three vertically oriented rods 24 which extend downwardly through hydro-pneumatic adjuster units 26 to base units 28 which anchor the mantle 20 and carriage plate 18 to ground. The mechanisms 26 can be used to determine the vertical location of the three corners of the mantle 20 thus adjusting the downward force applied through the springs 22 and the plate 18 and through the crusher rollers 16 to the table 12. According to Hooke's Law, the lower the position of the mantle 20, the greater the applied crusher force.

Figure 3:
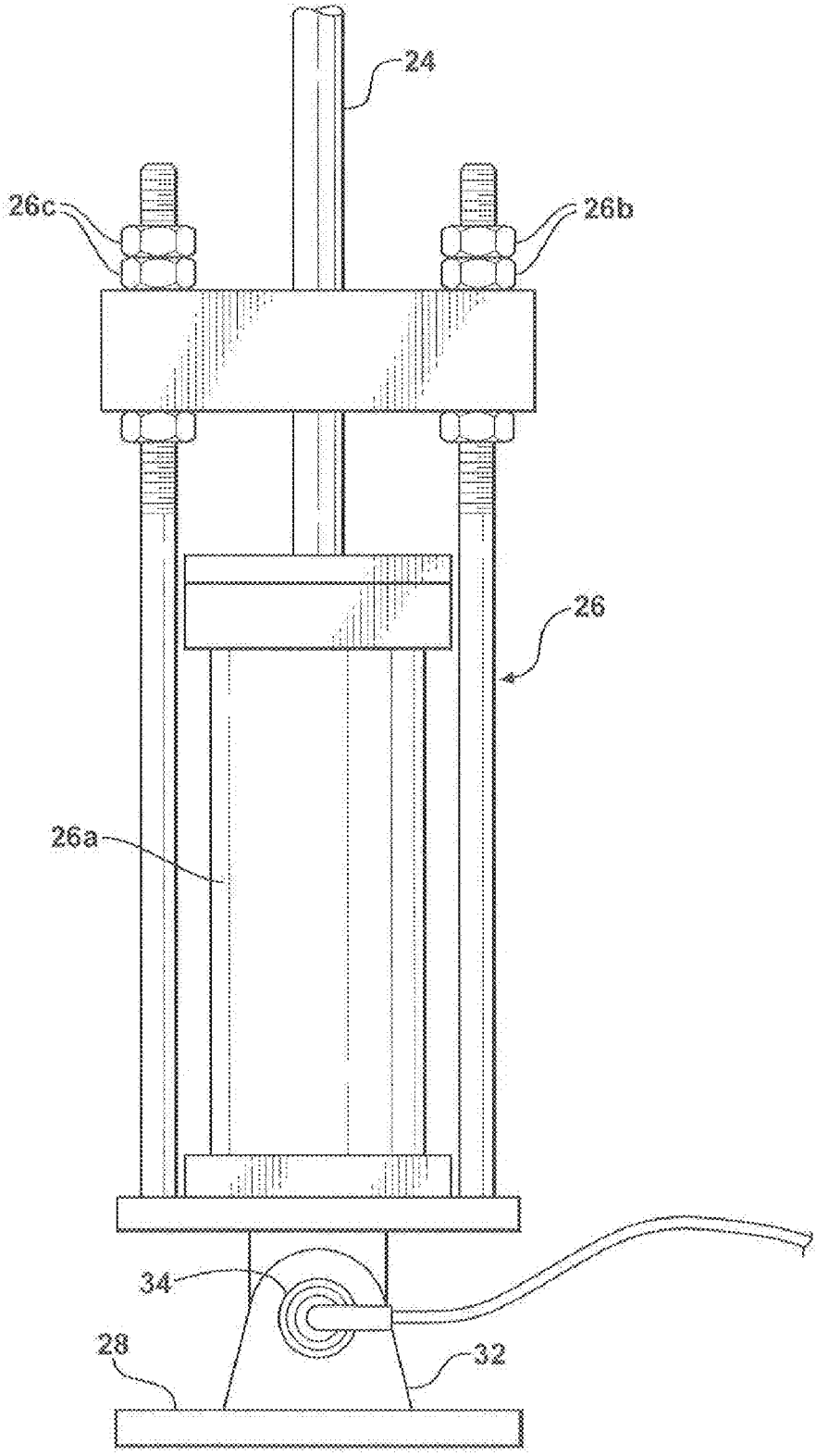
FIG. 3 is a detailed drawing of a hydro-pneumatic actuator used in the system of FIGS. 1 and 2.
Figure 4:
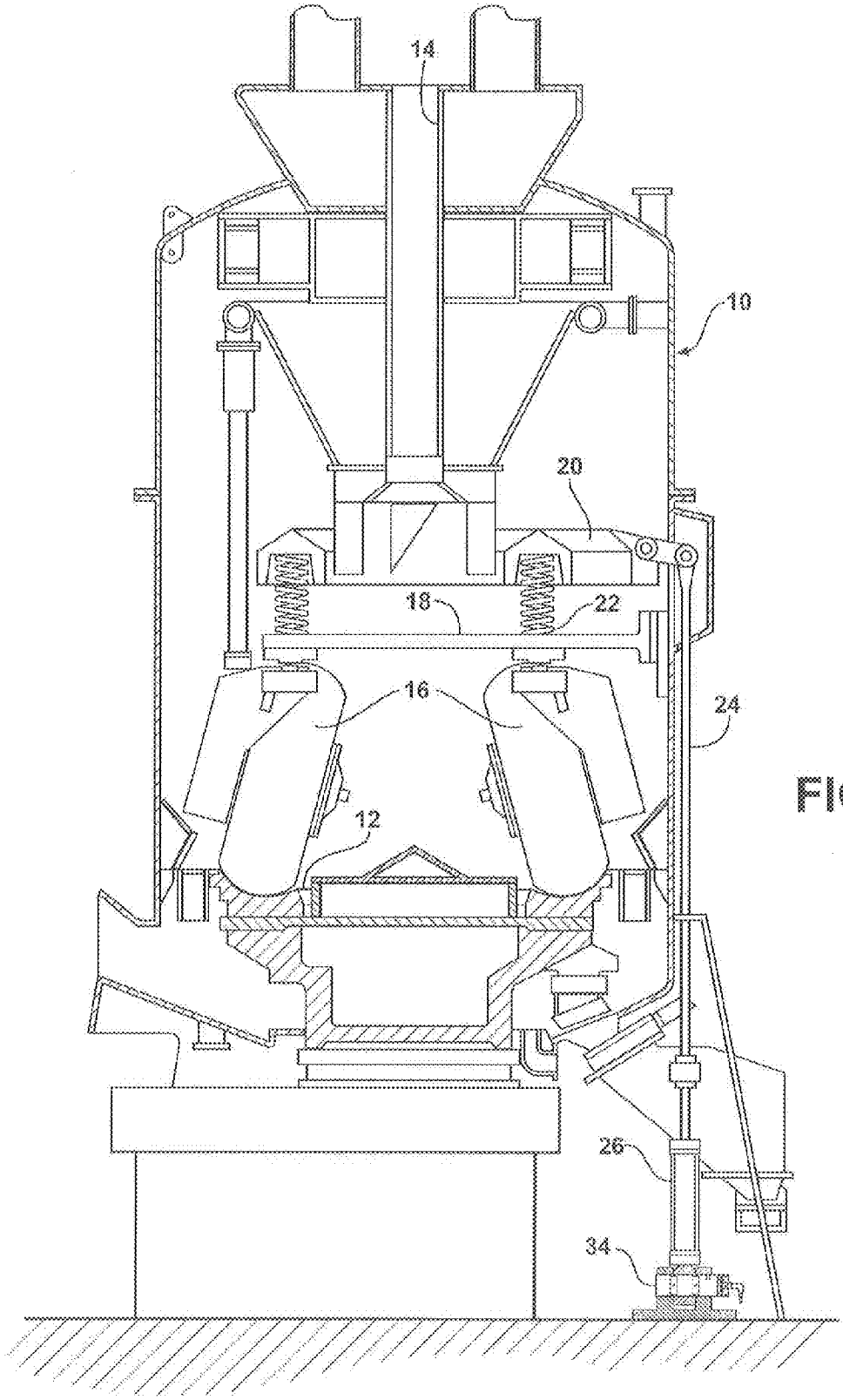
FIG. 4 is a cross-sectional view of a crusher/classifier of one type utilizing my invention and showing the details of the load cell force transducer location.
Figure 5:
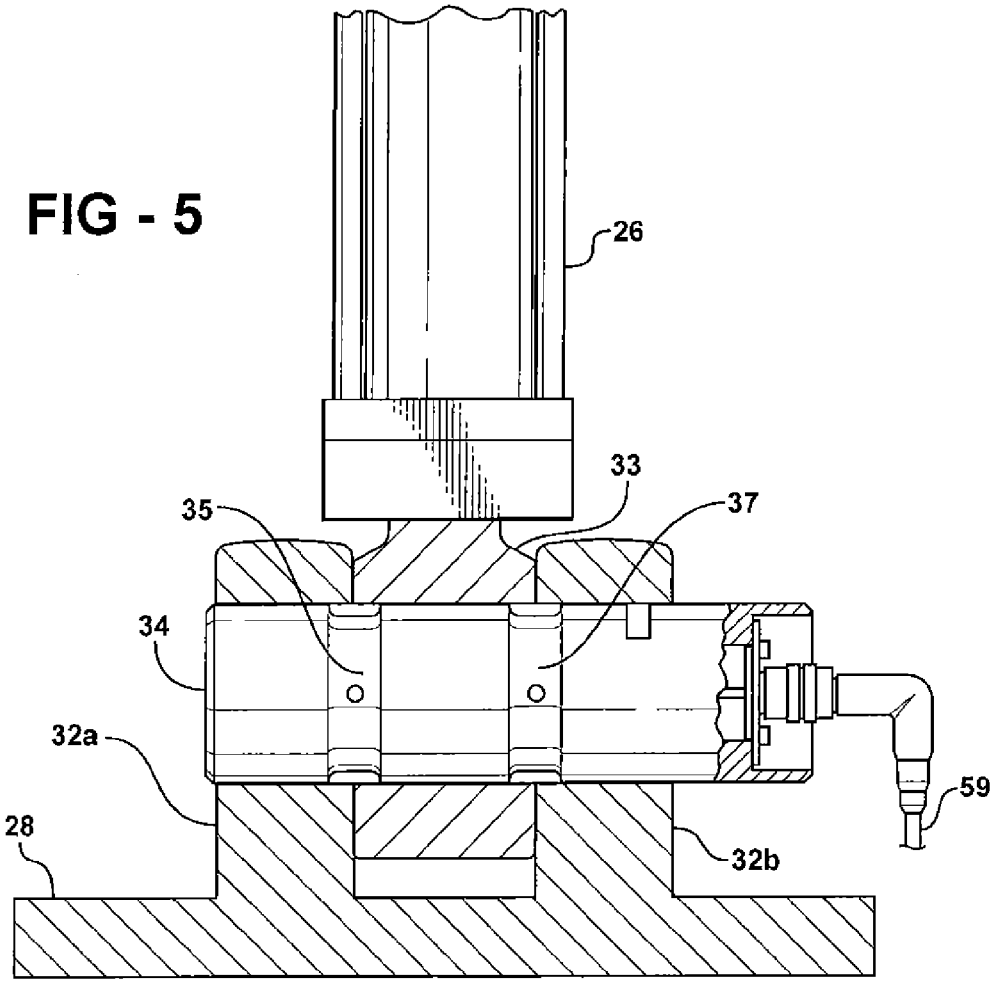
FIG. 5 is a cross-sectional view of the load cell of FIG. 4, showing how and where it is mounted in the suspension system clevis.

Shown to the right of the crusher/classifier 10 is a display unit 38 having three input lines 36*a*, 36*b*, 36*c* carrying electrical signals from the load cell type force transducers 34 which are located in the base units 28 as shown in greater detail in FIGS. 3, 4 and 5.

With respect to the detail, the base unit 28 defines a clevis having two upstanding shackle plates 32*a*, 32*b*, between which the lower eye 33 of the adjuster mechanism 26 fits as best shown in FIG. 5. The load cell type force transducer 34 takes the form of a pin which fits through aligned openings in the clevis shackle plates 32*a*, 32*b* and the eye 33 to mechanically secure them together while allowing some degree of rotation in the adjuster mechanism 26. Areas 35, 37 of reduced diameter are formed in the force transducer body to concentrate deflection caused by the forces applied through the member 33 to the load cell pin. Strain gages are bonded to the high deflection, load detection areas 35, 37 and, in accordance with known technology, are connected into a Whetstone bridge circuit to provide electrical signals which are out fed over the lines 36 to the display unit 38. The results of those signals appear on displays 40*a*, 40*b*, 40*c* representing the actual loads being seen at any given time by the three load cells 34 associated with the three force adjustment units 26. Ideally these loads are all close to equal.

Further in accordance with my invention, the electrical signals are passed through the display unit 38 on output lines 42 to a microprocessor/display unit 44 which is preferably located in a control room near the crusher/classifier unit 10 for supervision purposes. The processor unit 44 is programmed with reference level signals stored in appropriate memory locations which reference quantities are continuously compared to actual pressure force signals seen by the monitor 38. When the difference between the reference signal and the actual force signal, hereinafter referred to as an "error signal", exceeds a predetermined limit, a warning signal is generated either by flashing lights, an audio signal or by triggering a system shutdown function.

Figure 9:
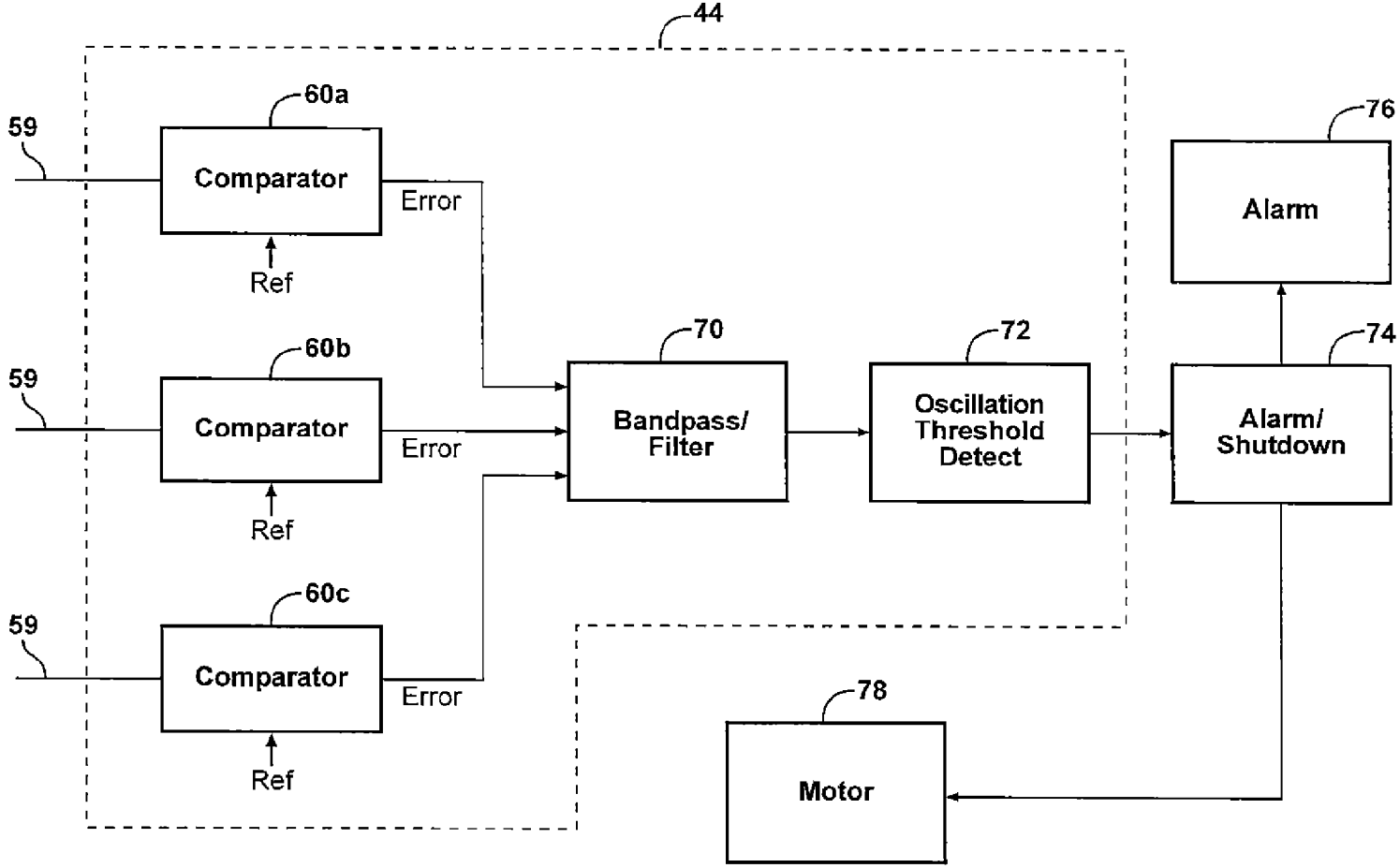

It is also within the scope of my invention as shown in FIG. 9 to incorporate an oscillation detector 72 into the microprocessor/display unit 44 which function detects repetitive, constant spikes in the measured force signal at the frequency of table rotation showing the presence of an uncrushable foreign object, such as a chunk of "tramp steel" in the crusher/classifier 10. Since this represents a threat to the integrity of the system as well as the effectiveness of the crusher/pulverizer function, that condition typically triggers a system shutdown and/or alarm function as well. A bandpass filter 70 to receive error signals from comparators 60*a*, 60*b*, 60*c* and tuned to a frequency related to the rate of table rotation can be used in combination with the detector 72 to sense this oscillation and take appropriate action at 74 to display a warning signal or send a shutdown signal to motor 78. The alarm function is carried out at 76.

Figure 8:
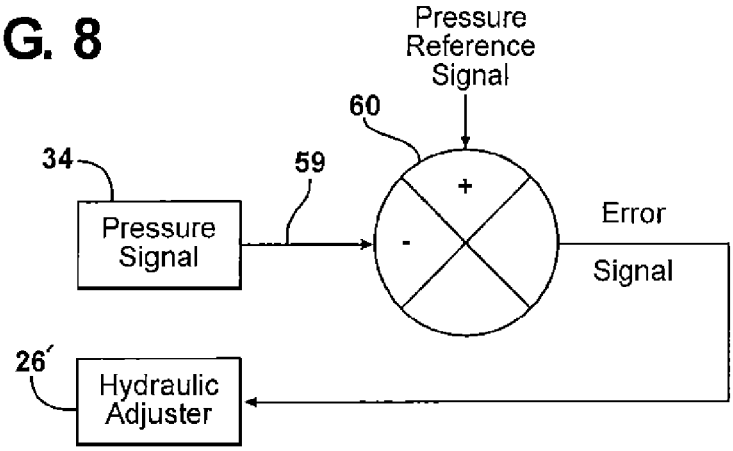
FIGS. 8 and 9 are schematic diagrams of a feedback loop which can be used in an automatic force adjustment system and an oscillation detector which can trigger an alarm or a system shutdown.

In normal practice, the adjusters 26 are set at the beginning of a run by the pneumatic cylinder 26*a* and the nuts 26*b* and 26*c* are tightened down to maintain the setting. Alternatively, the pneumatic adjuster can be replaced with a more powerful hydraulic cylinder 26' capable of continuous operation. As shown in FIG. 8, a reference signal representing desired pressure is applied to an input of a comparator 60. Another comparator input of opposite polarity comes from a pressure-sensing load cell 34 in one of the suspension system tensioners shown in FIGS. 1-4. The difference signal is output as an error and is fed to an hydraulic adjuster 26' to raise or lower the pressure signal from load cell 34 to reduce the error to zero.

Figure 6:
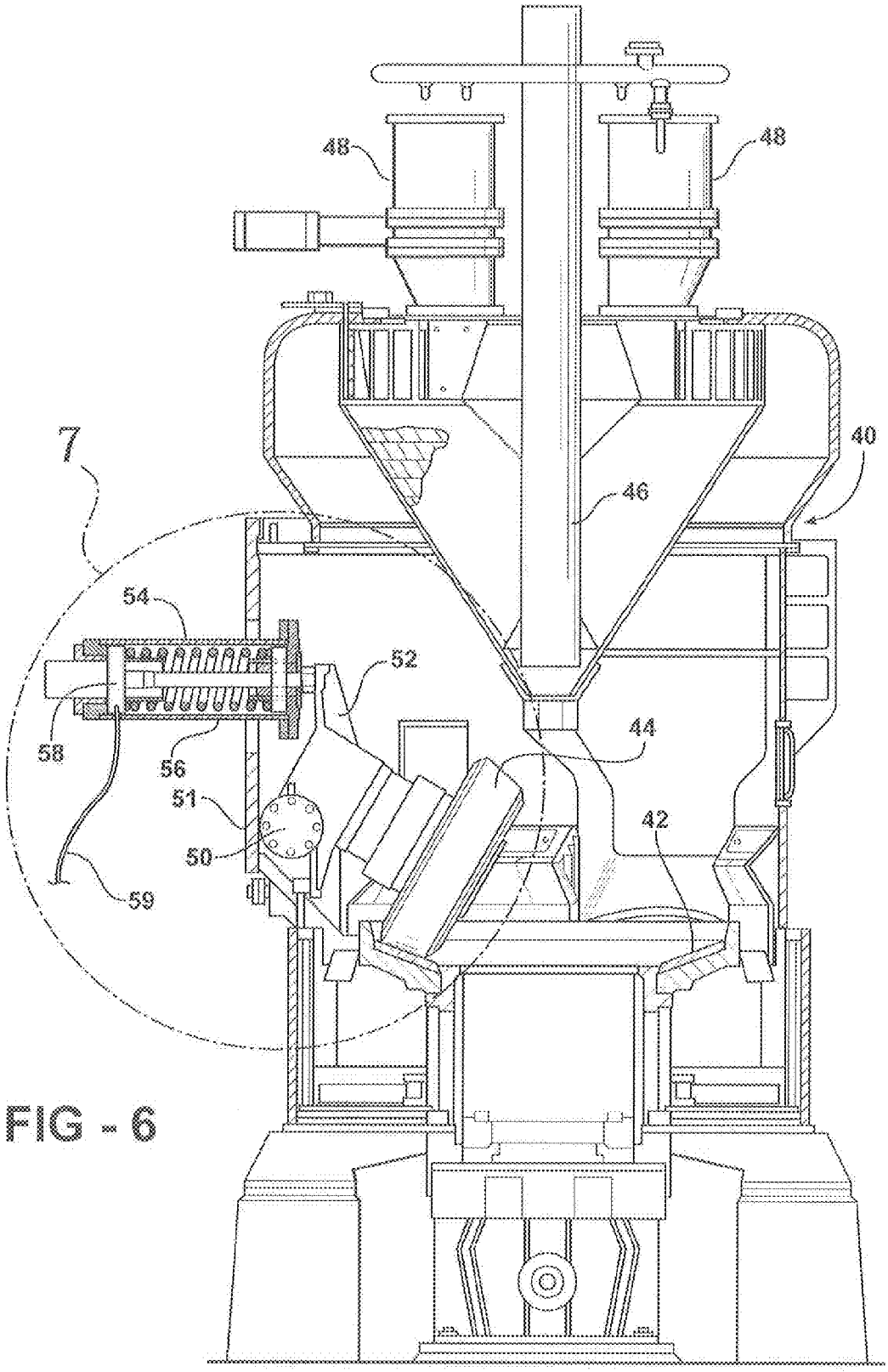
FIG. 6 is a cross-sectional view of a second type of crusher/classifier showing a different suspension system also including a load cell transducer in accordance with my invention.
Figure 7:
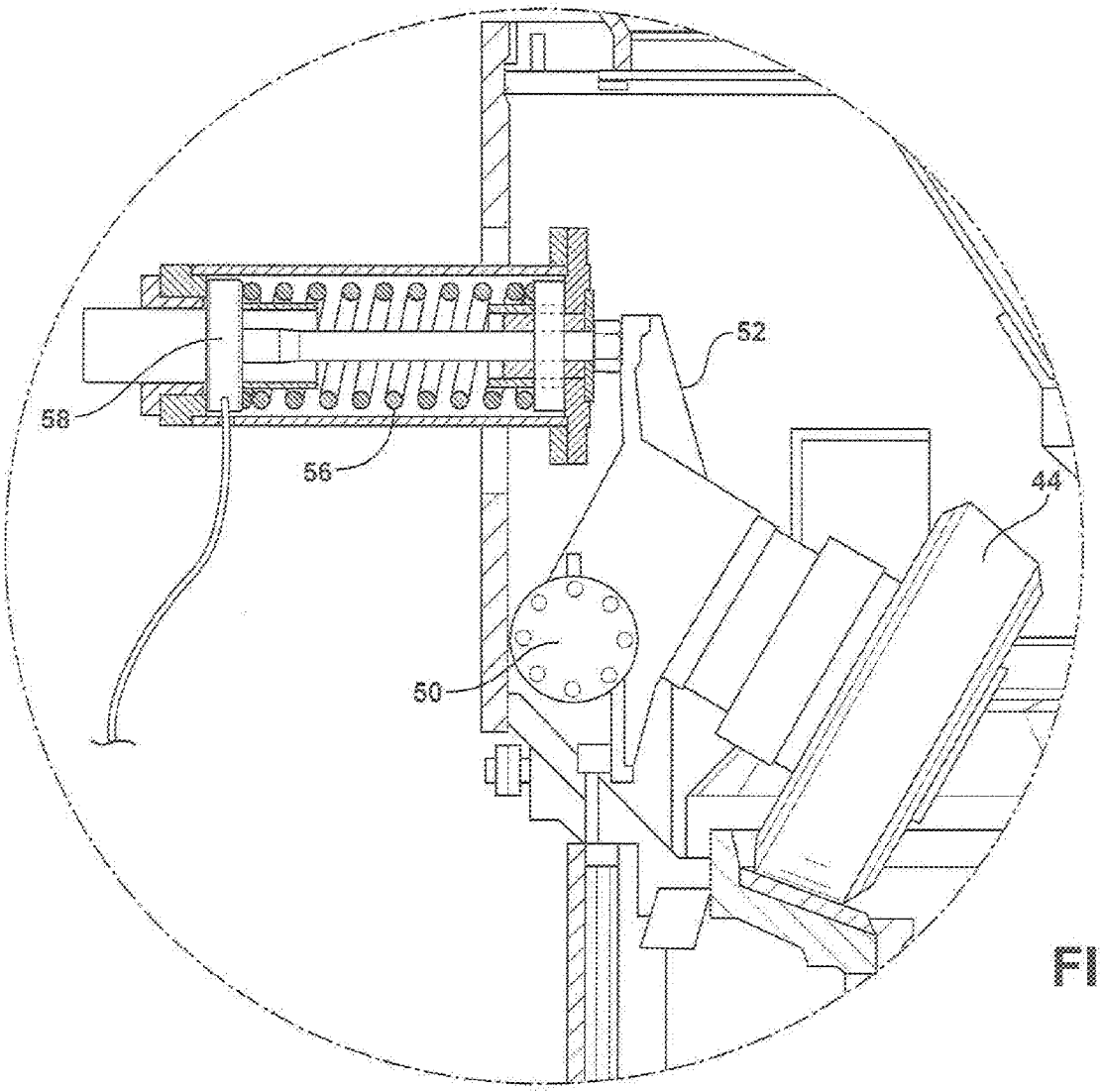
FIG. 7 is an enlarged detailed view of the suspension system and load cell location in the device of FIG. 6.

Referring now to FIGS. 6 and 7, a second type of crusher/pulverizer 40 is shown. This is also an updraft unit in which coal is fed through an intake pipe 46 onto a table 42 which is contacted by a series of three crusher rollers 44. Fully crushed fines exits through updraft conduits 48 where they may be conveyed to the combustion chamber.

In the embodiment of FIGS. 6 and 7, the suspension systems for the crusher rollers 44 are located laterally of the rollers and include crank arms 52 attached to the crusher/classifier frame 51 by pivots 50. The upper portions of the arms 52 are connected to adjustable spring units 54 which extend laterally through a door in the pulverizer body as best shown in FIG. 7. A spring 56 within the unit 54 provides a dampened suspension function in which the crusher roller 44 is allowed to ride upwardly in a counterclockwise direction around the pivot 50 to accommodate material on a surface of the table 42

In accordance with my invention, a load cell force transducer 58 is connected as a cross-pin into the suspension system to generate electrical signals representing actual crusher force for the associated roller 44 which are carried out on line 59 to a display and/or automatic adjustment system of the type shown in FIG. 1. There are three such suspension systems and force transducers in the device of FIGS. 6 and 7 as will be appreciated by persons skilled in the art.

In summary, my invention provides precise setting and monitoring of the force quantities in roller-type crusher/pulverizer systems as well as the capacity for automatic feedback type pressure setting maintenance. Load cell force transducers are available from a number of different sources in a number of different configurations to accommodate different suspension systems, the two used as illustrations herein representing a large number of the crusher/classifier devices in use today. As stated above, my invention can be used not only in coal crusher/classifiers but also in other crusher devices for other materials including metal ore.

What is claimed is:

1. In a crusher/classifier of the type comprising a table for receiving material to be crushed, a plurality of rollers contacting the surface of the table, and an adjustable suspension system including one or more suspension springs and an adjuster mechanism for setting the desired pressure to be exerted by the rollers on the table by way of said one or more suspension springs during operation, the improvement which comprises:

one or more load cell force transducers connected into the adjustable suspension system for at least one roller for producing electrical signals representing the actual pressure exerted by that roller on material on the table during operation of the crusher/classifier;

said suspension comprising a spring carriage and a plurality of rods grounding the carriage, a plurality of clevis anchors, said load cell transducers comprising force transducer pins extending through said clevises to be anchored thereby, said rods incorporating adjuster mechanisms and being mechanically attached to said load cell pins to apply a strain to said pins representing roller pressure.

2. The improvement described by claim 1 wherein the adjuster mechanics comprise one or more actuators and feedback means for adjusting the actuators in response to said electrical signals to maintain a desired pressure setting.

3. The crusher/classifier defined in claim 1 further comprising a detector for detecting periodic transients in the pressure signals produced by said force transducers.

4. The crusher/classifier as defined in claim 3 further including means for detecting and indicating periodic variations in the signals at a frequency related to the rate of rotation of the table.

5. A crusher/classifier comprising:

a table for receiving material to be crushed;

means for rotating the table at a desired speed of rotation;

a plurality of rollers contacting the surface of the table;

an adjustable suspension system including for each roller, at least one compression spring and means including an hydraulic cylinder and a rod for varying the compression force produced by said spring on said table via said roller; a clevis having spaced-apart shackle plates; and at least one load cell force transducer connected into the suspension system for said roller and including a pin inserted through said shackle plates and having one or more deflection concentration areas formed centrally therein so as to lie between said shackle plates, said rod being connected to said pin to apply a load thereto related to the load experienced by said spring on said concentration areas for producing signals related to transmitted force.

* * * * *